United States Patent [19]

Aruga et al.

[11] Patent Number: 5,000,142

[45] Date of Patent: Mar. 19, 1991

[54] CHAIN COVER APPARATUS FOR ENGINE

[75] Inventors: Tatsuo Aruga, Kawasaki; Yoshio Iwasa, Nagareyama, both of Japan

[73] Assignee: Nissan Motor Co., Ltd., Yokohama, Japan

[21] Appl. No.: 467,533

[22] Filed: Jan. 19, 1990

[30] Foreign Application Priority Data

Feb. 8, 1989 [JP] Japan ..... 1-27602

[51] Int. Cl.[5] ..... F02B 77/00

[52] U.S. Cl. ..... 123/195 C; 123/198 E

[58] Field of Search ..... 123/195 C, 195 S, 198 E

[56] References Cited

U.S. PATENT DOCUMENTS

| | | | |
|---|---|---|---|
| 4,257,370 | 3/1981 | Kasting | 123/198 E |
| 4,480,609 | 11/1984 | Hayashi | 123/198 E |
| 4,559,910 | 12/1985 | Tsuchiyama et al. | 123/198 E |
| 4,607,601 | 8/1986 | Kohler | 123/195 C |
| 4,817,967 | 4/1989 | Belter | 123/198 E |
| 4,883,031 | 11/1989 | Ampferer et al. | 123/195 C |

FOREIGN PATENT DOCUMENTS

| | | |
|---|---|---|
| 63-115509 | 7/1988 | Japan . |
| 63-179109 | 7/1988 | Japan . |

*Primary Examiner*—David A. Okonsky
*Assistant Examiner*—Weilun Lo
*Attorney, Agent, or Firm*—Foley & Lardner

[57] ABSTRACT

To reduce the size and weight and the number of parts required for a chain cover apparatus for an engine, the chain cover for covering a chain for transmitting a rotational force of a crankshaft to at least one camshaft mounted on a cylinder head comprises a chain cover formed with a cylindrical hollow projection portion extending frontward and having a hole through which the crankshaft is passed, and an oil pump accommodated within the cylindrical hollow projection portion and driven by the crankshaft. Further, the chain cover is formed with a semicircular flange portion formed at a lower wall of the cylindrical hollow projection portion so as to be joined with an oil pump, and with two flat flanges formed on both sides of the cylindrical hollow projection portion so as to be joined between the oil pan and the engine block.

3 Claims, 4 Drawing Sheets

CHAIN COVER APPARATUS FOR ENGINE

BACKGROUND OF THE INVENTION

1. Field of the Invention

The present invention relates to a chain cover apparatus for an internal combustion engine, which can cover chains reeved around a crankshaft and camshafts mounted on a cylinder head to open and close intake and exhaust valves.

2. Description of the Prior Art

Prior-art chain cover apparatus for covering chains reeved around a crankshaft and two camshafts are disclosed in Japanese Published Unexamined Patent Application No. 63-179109 or Japanese Published Unexamined Utility Model Application No. 63-115509, by way of examples.

In these prior-art chain cover apparatus, two camshafts mounted on a cylinder head and a crankshaft disposed in a cylinder block are connected by two chains, and these two chains are covered by a chain cover composed of an inner member and an outer member. Further, an oil pump is installed at the lower portion of the inner member.

In these prior-art chain cover apparatus, however, since the inner member disposed inside the chains and the oil pump is installed on the inner member are both covered by the outer member, there exist problems in that the apparatus size and weight are large; the number of parts is large; and therefore the manufacturing cost is high. In addition, in the prior-art apparatus, since an upper end of the oil pan is joined to a flange portion projecting from an outer wall of the oil pump, there exists another problem in that the total length of the oil pump increases.

SUMMARY OF THE INVENTION

With these problems in mind, therefore, it is the primary object of the present invention to provide a chain cover apparatus small in size and weight and in the number of parts required.

To achieve the above-mentioned object, the chain cover apparatus, according to the present invention, for covering at least one chain (7, 11) for transmitting a rotational force of a crankshaft (4) to at least one camshaft (8, 9) mounted on a cylinder head (2) fixed onto a cylinder block (1), comprising: (a) a chain cover (15) formed with a hollow projection portion (19) extending frontward from the cylinder block at a center of which a hole (19A) is formed to pass one end of the crankshaft; (b) an oil pump (21) accommodated within the hollow projection portion and driven by the crankshaft disposed passing through the hole formed at the center of said hollow projection portion.

The chain cover is further formed with a semicircular flange portion (22) formed at a lower wall of said hollow projection portion (19) coaxially with the crankshaft, in such a way as to be joined with a corresponding semicircular portion (24A) formed in an upper surface of an oil pan (24) and two flat flange portions (15A) formed on both sides of said semicircular flange portion and passing through the crankshaft center, in such a way as to be joined with other corresponding flat portions (24B) formed in the upper surface of the oil pan (24) and also with a lower skirt portion (1C) of the cylinder block.

In the chain cover apparatus according to the present invention, since the chain cover is formed with the cylindrical hollow projection portion for accommodating the oil pump together with the semicircular flange portion joined with an oil pan and two flat flange portions joined between the cylinder block and the oil pan, it is possible to minimize the size and weight and the number of parts required for the chain cover apparatus for an internal combustion engine.

DETAILED DESCRIPTION OF THE PREFERRED EMBODIMENTS

Prior to the description of an embodiment of the chain cover apparatus according to the present invention, chains and their related elements of a V-type DOHC (double overhead camshaft) engine to which the apparatus according to the present invention is applied will be explained by way of example.

Figure 1:
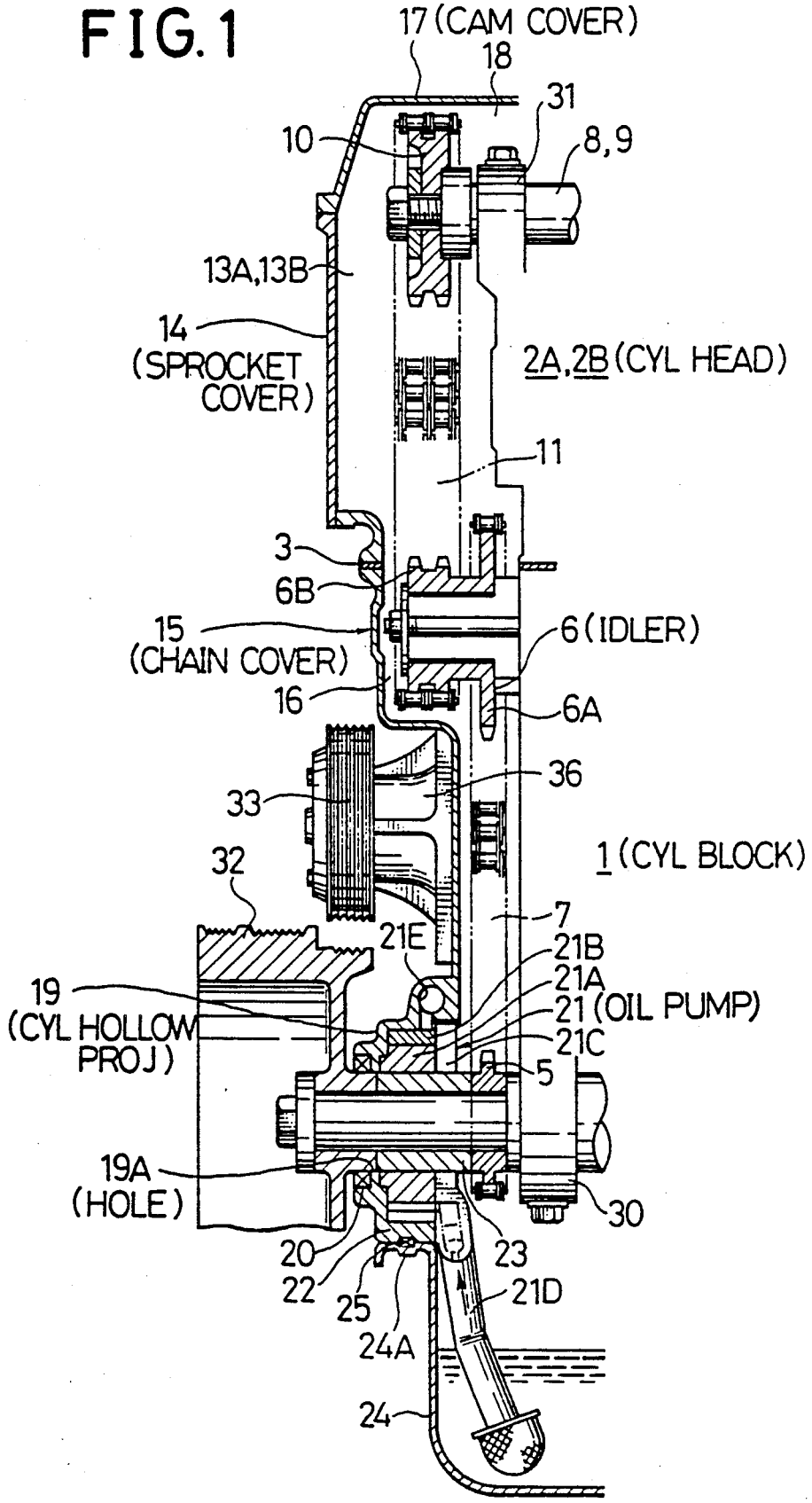
FIG. 1 is a cross-sectional view showing an embodiment of the chain cover apparatus according to the present invention together with other engine elements to be covered by the apparatus.
Figure 2:
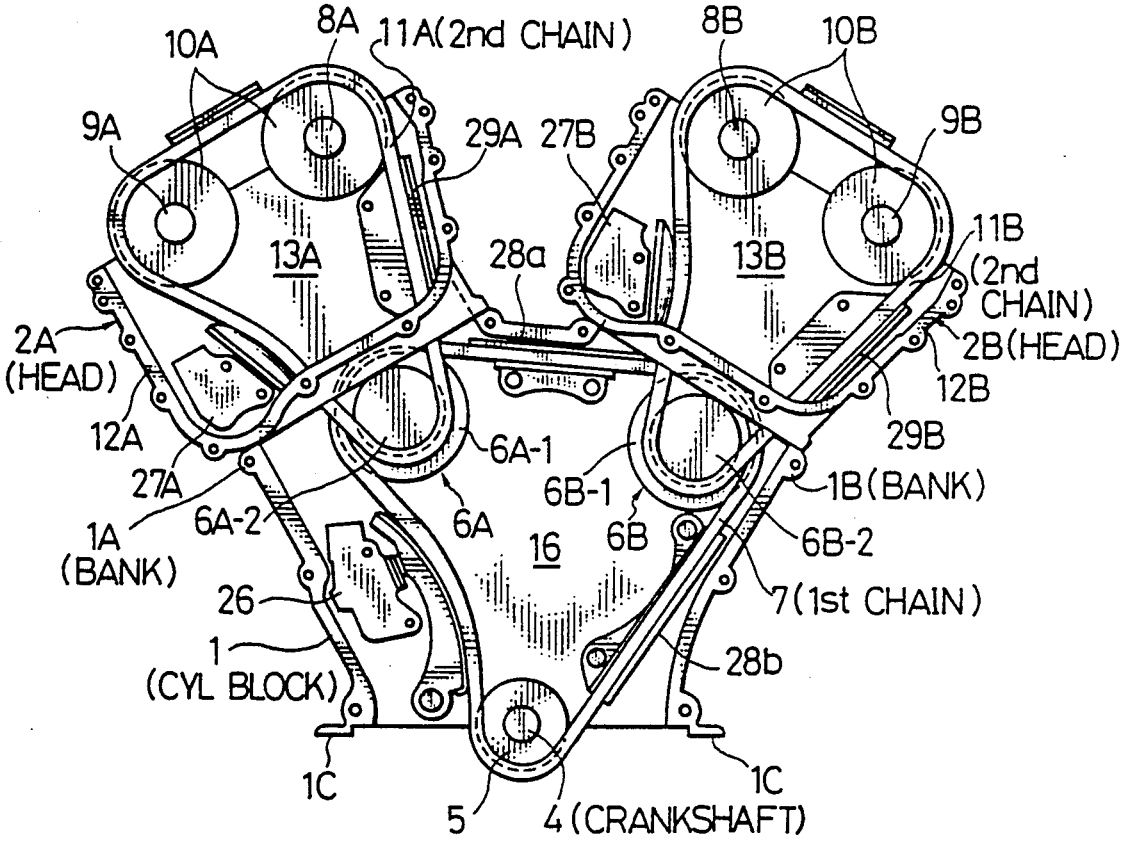
FIG. 2 is a front view showing a V-type DOHC engine including chains to be covered by the chain cover apparatus according to the present invention, by way of example.

With reference to FIGS. 1 and 2, a cylinder block 1 is formed with two V-shaped banks 1A and 1B. Further, two cylinder heads 2A and 2B are mounted on the upper portions of these banks 1A and 1B, respectively via gaskets 3 (FIG. 1). Further, engine cylinders of one bank 1A are arranged between two adjacent cylinders of the other bank 1B, alternately.

A crankshaft 4 is rotatably supported by a crankshaft bearing 30 (FIG. 1) at the lower position of the cylinder block 1, and a first sprocket 5 is fixed to an end of the crankshaft 4. Two idler chain wheels 6A and 6B are rotatably arranged at the two banks 1A and 1B of the cylinder block 1, respectively. Each idler chain wheel 6A or 6B is formed with a large-diameter sprocket 6A-1 or 6B-1 and a small-diameter sprocket 6A-2 or 6B-2, respectively.

A first chain 7 is reeved around the first sprocket 5 and two large-diameter sprockets 6A-1 and 6B-1 of the two idler chain wheels 6A and 6B. Here, the sprocket gear ratio of the first sprocket 5 and the large-diameter sprocket 6A-1 or 6B-1 is so determined that the rotative speed of the idler chain wheel 6A or 6B can be reduced down to $\frac{3}{4}$ to $\frac{1}{2}$ of that of the crankshaft 4.

On the upper side of each cylinder head 2A or 2B, an intake camshaft 8A or 8B for opening and closing intake valves (not shown) and an exhaust camshaft 9A or 9B for opening and closing exhaust valves (not shown) are rotatably supported by bearings 31 (FIG. 1), respectively. Two second sprockets 10A are attached to both ends of these two intake and exhaust camshafts 8A and 9A, and two other second sprockets 10B are attached to both ends of these two intake and exhaust camshafts 8B and 9B. A second chain 11A is reeved around the small-diameter sprocket 6A-2 of the idler chain wheel 6A and the two second sprockets 10A at the bank 1A, and another second chain 11B is reeved around the small-diameter sprocket 6B-2 of the idler chain wheel 6B and the two second sprockets 10B at the bank 1B.

To accommodate the two second sprockets 10A or 10B, each sprocket chamber 13A or 13B is formed by extending each outside end wall 12A or 12B toward the outside from each side wall of the cylinder head 2A or 2B so that each sprocket chamber 13A or 13B can be open toward the three upward, sideward and downward directions.

In FIG. 2, a pivotal tensioner 26 is mounted at the lower position of the cylinder block 1 to adjust the tension of the first chain 7, and two pivotal tensioners 27A and 27B are mounted within the cylinder heads 2A and 2B, respectively to adjust the tension of the second chain 11A or 11B. Further, the first chain 7 is guided along two fixed tensioners **28*a* and 28*b* and the second chain 11A or 11B is guided along a fixed tensioner 29A or 29B**, respectively.

With reference to FIG. 1, an engine cover is composed of an angled cam cover 17, a flat sprocket cover 14 and a chain cover 15 according to the present invention. The angled cover 17 is disposed on each cylinder head 2A or 2B to cover two cam chambers 18 in which the two intake and exhaust camshafts 8A and 9A or the two intake and exhaust camshafts 8B and 9B are arranged, respectively. The flat sprocket cover 14 is fixed to each side wall of each cylinder head 2A or 2B, respectively to cover each sprocket chamber 13A or 13B in which the two second sprockets 10A or 10B are arranged. The chain cover 15 according to the present invention (e.g. made of aluminum) is fixed to the side wall of the cylinder block 1 to cover an idler chamber 16 in which the two idler chain wheels 6A and 6B and the first sprocket 5 are arranged.

This chain cover 15 is formed with a cylindrical hollow projection portion 19 extending frontward from the cylinder block at such a position that the first sprocket 5 or the crankshaft 4 is located. Further, a hole 19A is formed at the center of the cylindrical hollow projection portion 19 so that an outer end of the crankshaft 4 is passed therethrough via a sealing member 20.

Figure 3:
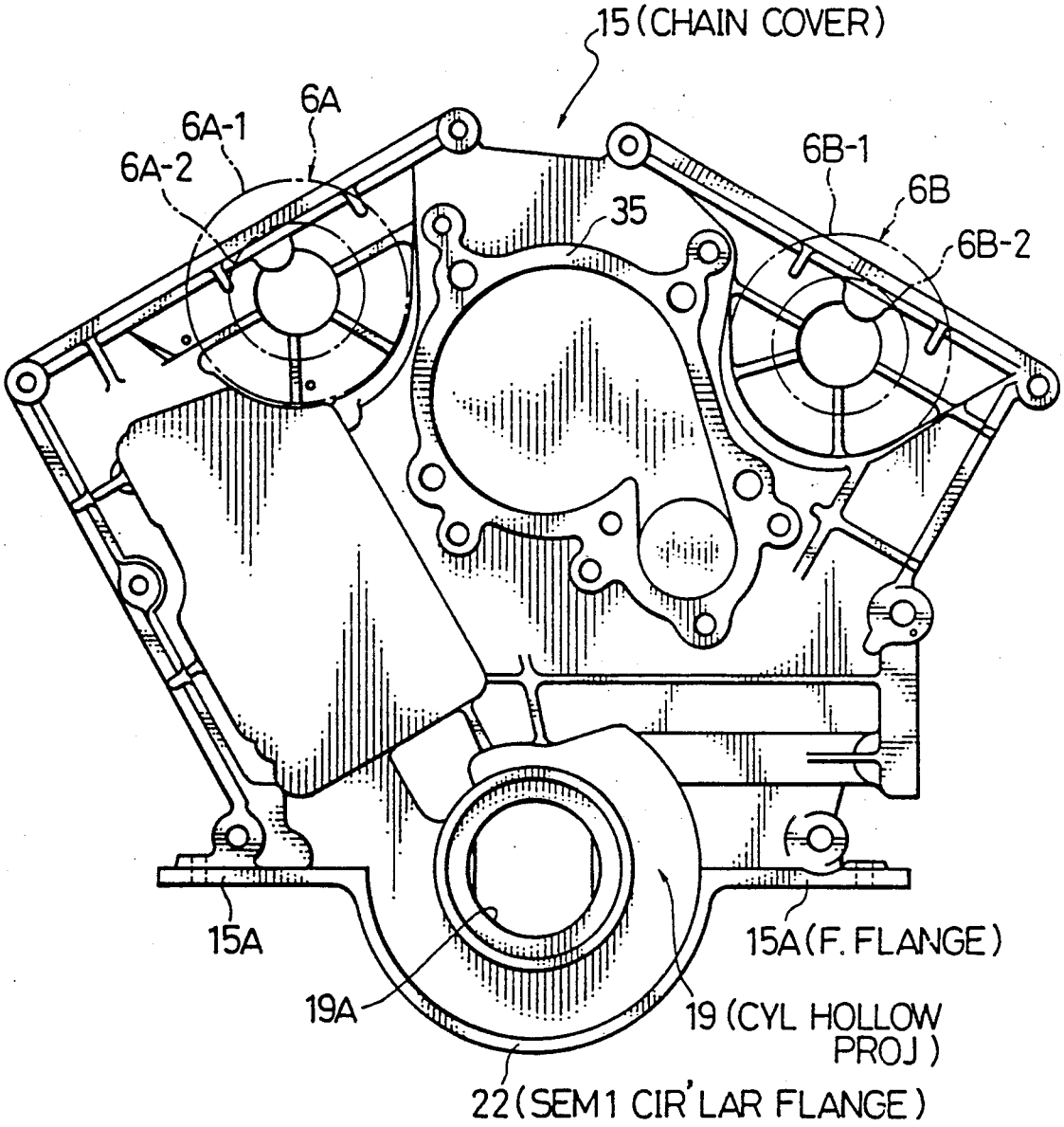
FIG. 3 is a front view showing the same embodiment of the chain cover according to the present invention.

Further, the chain cover 15 is formed with a semicircular flange portion 22 at the lower wall of the cylindrical hollow projection portion 19 coaxially with the crankshaft in such a way as to project in the downward direction, as depicted in FIG. 3. In addition, two flat (straight) flange portions 15A are formed extending from both the sides of the semicylindrical flange portion 22 so as to be flush with the lower skirt portion 1C (FIG. 2) of the cylinder block 1, as depicted in FIG. 3. The lower skirt portion 1C or the flat flange portions 15A are located at roughly the same height as that of the center of the crankshaft 5.

In addition, an oil pump 21 is accommodated within this cylindrical hollow projection portion 19, as shown in FIG. 1. The oil pump 21 is of gear pump type, which comprises an inner gear 21A fixed to the crankshaft 4 via a spacer ring 23, an outer gear 21B in mesh with the inner gear 21A, a rear pump plate 21C for supporting these gears 21A and 21B, an inlet passage 21D and an outlet passage 21E both connected to the rear pump plate 21C.

Therefore, when the inner gear 21A is driven by the crankshaft 4 via the spacer ring 23, since the inner gear 21A and the outer gear 21B are rotated in mesh with each other, lubricant within an oil pan 24 is introduced into the oil pump 21 through the inlet passage 21D, pressurized between the two gears 21A and 21B, and then supplied to various engine elements through the outlet passage 21E.

Figure 5:
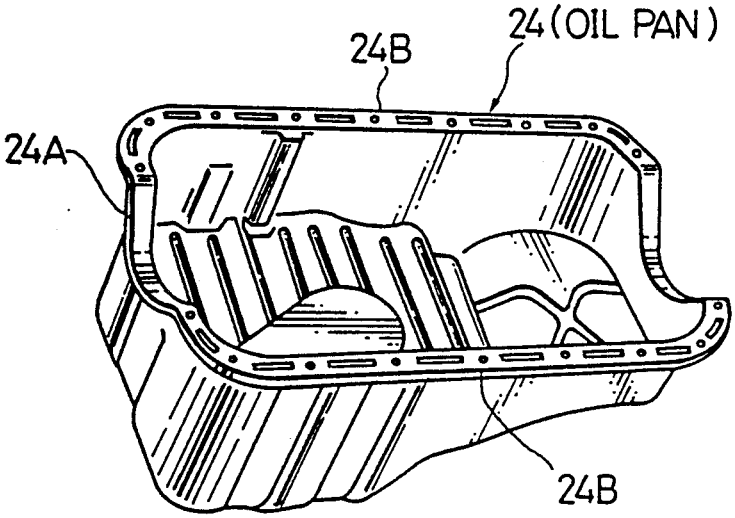
FIG. 5 is a perspective view showing an oil pan attached to the bottom of the chain cover apparatus according to the present invention.

As shown in FIG. 5, the oil pan 24 is formed with a semicircular concave flange portion 24A to which the semicircular flange portion 22 of the chain cover 15 is fitted via a seal member 25 (FIG. 1), and two flat flange portions 24B to which the two flat flange portions 15A of the chain cover 15 are fitted via the same seal member 25.

Further, in FIG. 3, the chain cover 15 is formed with a roughly circular flange portion 35 to which a block 36 (FIG. 1) is fixed to rotatably support a pulley 33 for driving a water pump, for instance. Furthermore, another pulley 32 is fixed to an outermost end of the crankshaft 4 to drive other auxiliary devices (not shown).

In the above chain cover apparatus, since the cylindrical hollow projection portion 19 is formed at the lower end of the chain cover 15 so a to cover the first sprocket 5 and further the hole 19A through which the crankshaft 4 can be passed is formed at the center of the cylindrical hollow projection portion 19, so that the oil pump 21 driven by the crankshaft 4 can be accommodated within the cylindrical hollow projection portion 19, there exists such an advantage that the oil pump 21 can be directly mounted on the inner surface of the chain cover 15 without providing specific sealing members between the oil pump and the chain cover, thus decreasing the size and the number of parts. In addition, since the cylindrical hollow projection portion 19 of the chain cover 14 serves as an outer wall of the oil pump, it is possible to effectively cool the oil pump by the open air directly.

Further, the semicircular flange portion 22 is formed at the lower wall portion of the cylindrical hollow projection portion 19 so as to be joined with the semicircular concave flange portion 24A of the oil pan 24, it is unnecessary to provide a special flange projecting frontward from the oil pump as is conventional, thus decreasing the size (total length) and the weight of the oil pan. Further, since the lowermost skirt portion 1C of the cylinder block 1 extends downward only to the center of the crankshaft 4, it is possible to reduce the height of the cylinder block 1, thus reducing the weight of the engine.

Further, since the two flat flange portions 15A are formed at the lowermost position of the chain cover 15 extending from both the sides of the semicircular flange portion 22 so as to be flush with the lower skirt portion 1C of the cylinder block 1 and so as to be joined with the two flat flange portions 24B of the oil pan 24, it is possible to directly fixed the oil pan 24 to the lower end portion of the chain cover 15 with bolts, thus markedly increasing the rigidity of the chain cover 15, that is, reducing noise generated by vibration of the oil pan due to engine vibration.

Figure 4:
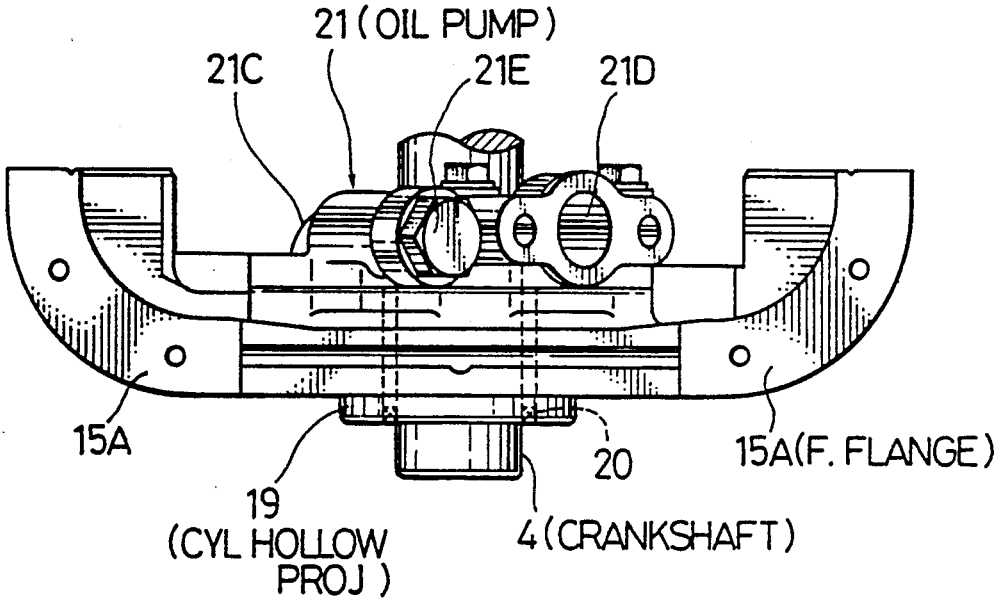
FIG. 4 is a bottom view of the chain cover shown in FIG. 3.

Furthermore, since the two corners of the two flat flange portions 15A of the chain cover 15 are curved as shown in FIG. 4, when seen from the bottom, it is possible to increase the amount of lubricant stored in the oil pan to such an extent that spaces enclosed by the curved flat flange portions 15A and the semicircular flange portion 22. In the above description, a V-type DOHC engine is described by way of example, without being limited, however, the chain cover according to the present invention can be of course applied to various engines of other types.

As described above, in the chain cover apparatus according to the present invention, since the chain cover is formed with the cylindrical hollow projection portion (at the center of which the crankshaft is passed and within which the oil pump is accommodated so as to be driven by the crankshaft), and additionally with the semicircular flange and two flat (straight) flanges at the lower end wall thereof so as to be joined with the oil pan, it is possible to reduce the size and weight and the number of parts of the apparatus markedly.

What is claimed is:

1. A chain cover apparatus for covering at least one chain for transmitting a rotational force of a crankshaft to at least one camshaft mounted on a cylinder head fixed onto a cylinder block, comprising:

(a) a chain cover formed with a hollow projection portion extending frontward from the cylinder block at a center of which a hole is formed to pass one end of the crankshaft;

(b) an oil pump accommodated within the hollow projection portion and driven by the crankshaft disposed passing through the hole formed at the center of said hollow projection portion; and (c) a semicircular flange portion formed at a lower wall of said hollow projection portion coaxially with the crankshaft, in such a way as to be joined with a corresponding semicircular portion formed in an upper surface of an oil pan.

2. The chain cover apparatus of claim 1, wherein said chain cover is further formed with two flat flange portions formed on both sides of said semicircular flange portion and passing through the crankshaft center, in such a way as to be joined with other corresponding flat portions formed in the upper surface of the oil pan and also with a lower skirt portion of the cylinder block.

3. The chain cover apparatus of claim 1, wherein said oil pump comprises:

(a) an inner gear driven by the crankshaft;

(b) an outer gear in mesh with said inner gear; and (c) a rear pump plate fixed to said hollow projection portion formed in said chain cover to accommodate said inner and outer gears between an inner side wall of said hollow projection portion and said rear plates, said rear plate being formed with an inlet passage for introducing lubricant from an oil pan and an outlet passage for supplying pressurized lubricant for engine lubrication.

* * * * *